United States Patent [19]

Jamshidi

[11] 3,987,895

[45] Oct. 26, 1976

[54] DISPOSABLE LIVER BIOPSY TRAY

[76] Inventor: Khosrow Jamshidi, 610 Winston Court, St. Paul, Minn. 55118

[22] Filed: Oct. 6, 1975

[21] Appl. No.: 619,673

Related U.S. Application Data

[63] Continuation of Ser. No. 460,218, April 11, 1974, abandoned.

[52] U.S. Cl. ..... 206/72; 206/223

[51] Int. Cl.[2] ..... B65D 1/34

[58] Field of Search ..... 206/72, 223, 229, 370, 206/503; 217/26.5

[56] References Cited

UNITED STATES PATENTS

| | | | |
|---|---|---|---|
| 3,329,261 | 7/1967 | Serady | 206/229 |
| 3,467,247 | 9/1969 | Weiss | 206/72 |
| 3,567,067 | 1/1969 | Weiss | 206/72 |
| 3,802,555 | 4/1974 | Grasty et al. | 206/223 |

*Primary Examiner*—R. E. Hart
*Attorney, Agent, or Firm*—Orrin M. Haugen

[57] ABSTRACT

Biopsy tray means for sequentially conducting sterile procedures and comprising, in combination, upper and lower nested tray members retaining means for performing biopsy techniques in a sterile field. The upper tray of the nested pair is provided with a plurality of article supporting recesses formed within the top surface, with means for defining a sterile zone upon the body of a patient being releasably retained within said recesses. The lower tray of the nested pair is provided with collective apparatus for performing biopsy procedures, with the upper tray generally enveloping the lower tray so as to generally confine and conceal the upper surface of the lower tray from the ambient during the time that the sterile field is being defined on the body of the patient.

4 Claims, 4 Drawing Figures

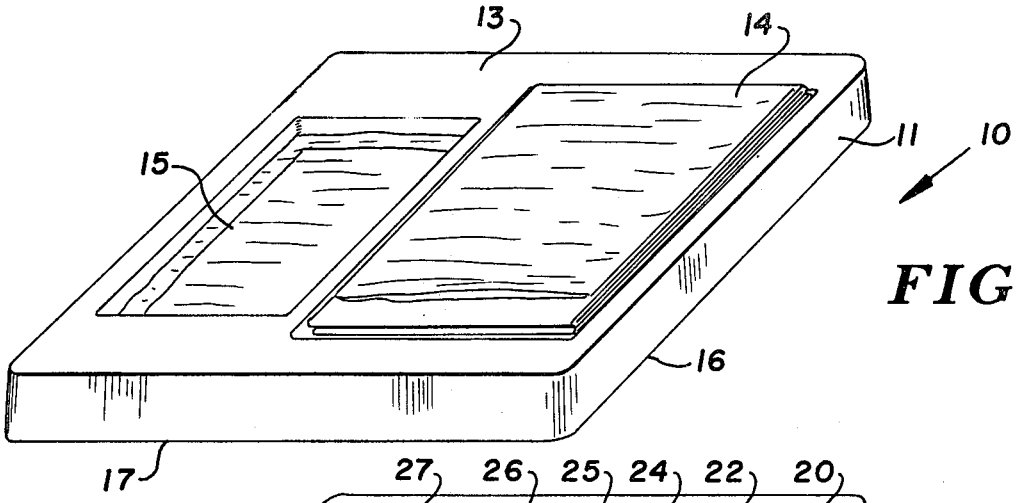
FIG. 1
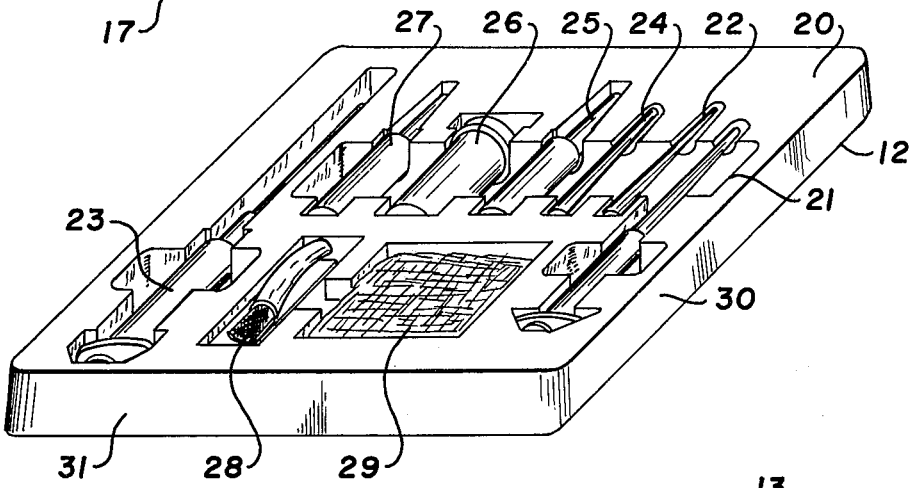
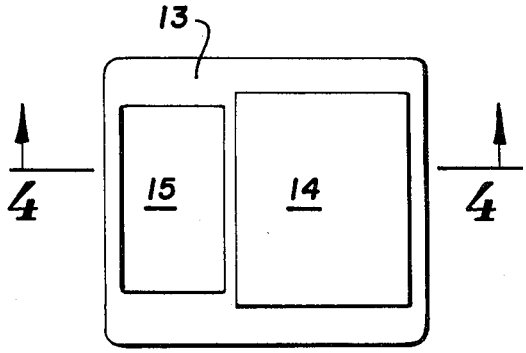
FIG. 2
FIG. 3
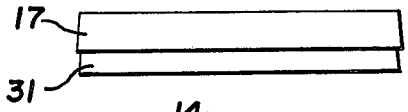
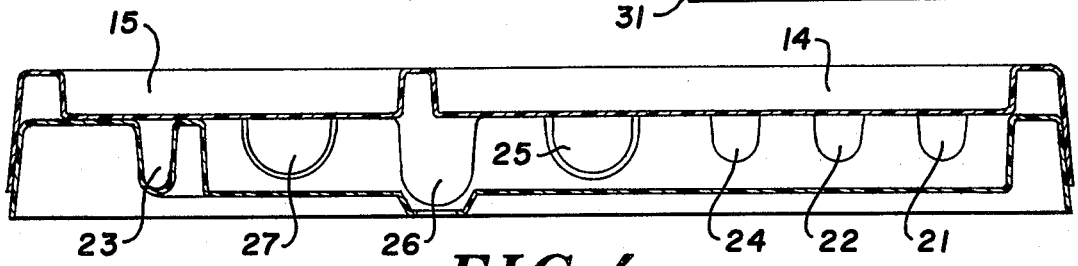
FIG. 4

DISPOSABLE LIVER BIOPSY TRAY

This is a continuation of application Ser. No. 460,218 filed Apr. 11, 1974.

BACKGROUND OF THE INVENTION

The present invention relates generally to an improved tray for use in retaining instruments and other items necessary for conducting biopsy procedures within a sterile field, and more specifically to a biopsy tray assembly which employs a pair of superimposed nested tray members, the upper tray being arranged to retain apparatus for preparing the sterile field, the lower tray being concealed from the ambient until such time as the sterile field has been established and the upper tray is removed so as to expose the lower tray to the surgeon.

In the course of conducting biopsy procedures, it is normally required that a sterile field be established before initiating the biopsy procedure. In order to permit the establishment of such a field, it had been necessary in the past to utilize separate materials for the various phases of the overall procedure, including one for the establishment of the sterile field, and a second for retention of the instruments, solutions and the like which are required for the actual taking of the specimen. For example, individual or sequentially delivered trays may be utilized, with the first tray being employed for the establishment of the sterile field, and with this tray being removed prior to the introduction of the second tray to the zone, so as to avoid contamination of the instruments, solution-containing vials, and the like required in the actual biopsy procedure.

SUMMARY OF THE INVENTION

In accordance with the present invention, however, it is possible to utilize a single in-place tray stack which comprises upper and lower nested trays, the upper tray containing materials for the establishment of a sterile field, and with the lower tray containing the actual instruments, solutions, and the like required in the biopsy procedure. The arrangement of the system of the present invention is particularly adapted for biopsy procedures involving soft tissue, such as those required for obtaining specimens of such organs as the liver, kidneys, spleen, and the like. It will be appreciated, of course, that the present invention is applicable to the obtaining of specimens from virtually any biopsy procedure, particularly where a sterile field is initially defined and provided.

Therefore, it is a primary object of the present invention to provide an improved tray assembly for utilization in biopsy procedures, particularly wherein a sterile field is initially defined, with the actual biopsy procedure being undertaken following the establishment of the sterile field.

It is a further object of the present invention to provide an improved biopsy tray means which employs a pair of nested tray members, the upper tray member retaining means for preparation of a sterile field on the body of a patient, the lower tray member retaining the actual collective apparatus required for the performing of a biopsy procedure within the body of a patient.

It is yet a further object of the present invention to provide an improved biopsy tray means including upper and lower nested tray members, wherein the upper tray member provides means for retaining those items necessary for the preparation of a sterile field on the body of a patient, and wherein the lower tray, which is normally concealed from the ambient by the upper tray contains those certain instruments, solution-containing vials, and the like normally required for the completion of the biopsy procedure.

Other and further objects of the present invention will become apparent to those skilled in the art upon a study of the following specification, appended claims, and accompanying drawing.

BRIEF DESCRIPTION OF THE DRAWING

FIG. 1 is a perspective view of the biopsy tray means of the present invention, and illustrating the upper and lower tray members in spaced apart disposition;

FIG. 2 is a top plan view, on a slightly reduced scale, of the upper tray of the nested pair;

FIG. 3 is a side elevational view, on a slightly reduced scale, of the biopsy tray means of the present invention, and illustrating the trays in nested disposition; and FIG. 4 is a vertical sectional view, on an enlarged scale from that of FIG. 2, and taken along the line and in the direction of the arrows 4—4 of FIG. 2.

DESCRIPTION OF THE PREFERRED EMBODIMENT

In accordance with the preferred embodiment of the present invention, the biopsy tray means generally designated 10 includes an upper tray member 11, and a lower tray member 12, with these trays being arranged to be disposed in nested disposition as is illustrated in the views of FIGS. 3 and 4.

Upper tray member 11 has an upper surface 13 in which are formed a pair of article supporting recesses 14 and 15, with sterile dyed tincture of benzalkonium chloride swabs normally being disposed in recess 15, and a polyethylene lined towel and a polyethylene lined fenestrated drape normally being disposed in recess 14. As is apparent from FIG. 1, the tray member 11 is provided with a closed top and an open bottom, with the top surface being generally planar, and having outwardly flaring depending flanges extending downwardly from the top surface, and extending as a continuum about the periphery of the upper surface 13.

These outwardly flaring depending flanges 16 and 17 form a base support which is arranged to nest about similar flanges extending from the surface of the lower tray member 12, thereby generally enveloping the depending flanges of the lower tray member and confining and concealing the upper surface of the lower tray member from the ambient.

Turning now to the details of the lower tray member 12, this tray member is also provided with a generally planar top surface 20 in which are formed a number of article retaining recesses. In this connection, the recesses formed in the upper surface of the lower tray member are arranged generally to retain those instruments and liquid containing vials, and the like which are necessary for the actual biopsy procedure. Specifically, in a liver biopsy tray as is illustrated in the drawings, a conventional syringe is shown as being retained within the cavity 21, with a 3 cc. syringe with a 20 × 1½ inch needle normally being attached thereto. An alternate needle, such as a 21 × 1½ inch needle is provided at 22, with a 25 × ⅝ inch alternate needle being provided at 24. For the actual obtaining of the biopsy specimen, a liver biopsy needle/syringe is provided as at 23, with this needle being preferably of the type disclosed and claimed in my copending application Ser. No. 454,064; filed Mar. 25, 1974, entitled "SOFT TISSUE BIOPSY DEVICE" now U.S. Pat. No. 3,882,849.

A 5 cc. ampule of saline solution (sodium chloride) is provided at 25, with a specimen receiving bottle being provided at 26. A quantity of Xylocaine hydrochloride is also provided, with a 5 cc. ampule of a 1% solution being provided as at 27. A scalpel blade with handle is preferably provided at 28, with a plurality of dry gauze pads being provided at 29.

As is provided in the upper tray member 11, outwardly flaring downwardly depending flanges are provided as at 30 and 31, with these flanges preferably being formed as a continuum about the periphery of the planar surface 20.

While the top surfaces of the individual tray members have been described as being generally planar, it will be appreciated that various recesses are formed in this planar surface for the purposes of retaining or otherwise receiving those components, instruments, or solution-containing vials normally required in a biopsy procedure.

It will be further appreciated that the upper nested tray member forms a shield covering virtually the entire upper exposed surface of the lower tray member. In this fashion, therefore, it is possible for the surgeon to sequentially conduct the biopsy procedure by initially forming the sterile field, while protecting those instruments which will be subsequently required for the actual biopsy procedure from exposure during the preparation of the sterile field.

The provision of recessed zones within the tray surface provides a convenient means for retaining the individual items in a proper disposition within the tray, without requiring or encountering movement, dislocation, or the like of the individual items. Once the surgeon is familiar with the placement of the individual items in the tray, the procedure moves far more expeditiously.

While the present arrangement has been described with specific attention being given to liver biopsy requirements, it will be appreciated that with only modest modifications, other biopsy trays may be arranged with those items normally required for other specific biopsy procedures including, for example, those items normally needed for taking biopsy samples of other soft organs such as kidney, spleen, and the like.

In carrying out the actual biopsy procedure, the surgeon will initially remove the nested tray members from a container, thereafter removing the sterile envelope from about the nested tray members. The entire contents of the envelope, including the nested trays, is placed on a flat surface adjacent the working area. The towel is then removed from the exposed upper tray member and placed under the patient's side, after which the puncture site is located and the area swabbed. Following swabbing, the drape is placed over the patient. At this point, the upper tray is removed from the lower tray and the remaining contents of the lower tray are then exposed to the ambient.

Thereafter, the biopsy procedure is undertaken in the usual fashion following established surgical protocol.

I claim:

1. Biopsy tray means for sequentially conducting sterile procedures and comprising, in combination, upper and lower nested tray members retaining means for performing biopsy techniques in a sterile field:

a. said upper tray consisting of a closed top and open bottom structure having a generally planar top surface with outwardly flaring depending flanges extending as a continuum about the periphery thereof and forming a base support, a plurality of article supporting recesses formed within said generally planar top surface of said upper tray member and having the edge surfaces thereof extending integrally as a continuum about the base surface of each of said recesses, and article means for preparing a sterile zone upon the body of a patient releasably retained within said upper tray recesses;

b. said lower tray consisting of a closed top and bottom structure having a generally planar top surface with outwardly flaring depending flanges extending as a continuum about the periphery thereof and forming a base support for said lower tray member, a plurality of article supporting recesses formed in said generally planar top surface of said lower tray member and having the edge surfaces thereof extending integrally as a continuum about the base surface of each of said recesses, and collective apparatus for performing the specific operations of the biopsy procedure upon the body of a patient, said collective apparatus being releasably retained within said lower tray recesses;

c. the inner surfaces of the outwardly flaring depending flanges of said upper tray member generally enveloping and sealingly engaging the outer surfaces of the outwardly flaring depending flanges of said lower tray member along an extended portion of the depending flange surface so as to generally confine and conceal the upper surface of said lower tray member and the articles supported thereby from the ambient.

2. The biopsy tray means as defined in claim 1 being particularly characterized in that the top surface of each of said upper and lower nested tray members is generally rectangular in configuration, with each of said upper and lower nested tray members having generally similar peripheral dimensions.

3. The biopsy tray means as defined in claim 1 being particularly characterized in that said means for defining a sterile zone upon the body of a patient includes sterile swab means, towel means, and sterile field exposing drape means.

4. The biopsy tray means as defined in claim 1 being particularly characterized in that said upper tray is arranged to function as an isolating barrier for the upper surface of said lower tray member.

* * * * *